US005732691A

United States Patent [19]

Maiello et al.

[11] Patent Number: 5,732,691

[45] Date of Patent: Mar. 31, 1998

[54] MODULATING FURNACE WITH TWO-SPEED DRAFT INDUCER

[75] Inventors: Dennis R. Maiello; Scott A. Willbanks, both of Fort Smith, Ark.

[73] Assignee: Rheem Manufacturing Company, New York, N.Y.

[21] Appl. No.: 752,371

[22] Filed: Oct. 30, 1996

[51] Int. Cl.[6] ..... F24H 3/00

[52] U.S. Cl. ..... 126/116 A; 126/110 R

[58] Field of Search ..... 126/110 R, 116 A

[56] References Cited

U.S. PATENT DOCUMENTS

| | | | |
|---|---|---|---|
| 4,309,977 | 1/1982 | Kitchen | 126/99 A |
| 4,421,268 | 12/1983 | Bassett et al. | 236/10 |
| 4,638,942 | 1/1987 | Ballard et al. | 236/10 |
| 4,703,747 | 11/1987 | Thompson et al. | 126/112 |
| 4,729,207 | 3/1988 | Dempsey et al. | 126/112 |
| 4,887,767 | 12/1989 | Thompson et al. | 236/1 EB |
| 4,962,749 | 10/1990 | Dempsey et al. | 126/116 A |
| 4,976,459 | 12/1990 | Lynch | 236/11 |
| 5,027,789 | 7/1991 | Lynch | 126/116 A |
| 5,347,981 | 9/1994 | Southern et al. | 126/116 A |
| 5,379,752 | 1/1995 | Virgil et al. | 126/116 A |
| 5,601,071 | 2/1997 | Carr et al. | 126/110 R |

*Primary Examiner*—Carroll B. Dority
*Attorney, Agent, or Firm*—Konneker & Smith, P.C.

[57] ABSTRACT

A modulating, forced draft, fuel-fired air heating furnace is provided with a two-speed draft inducer fan, and a fuel valve which is fully modulatable between a maximum firing rate and a low firing rate of approximately forty percent thereof. Incorporated into the furnace control system are normally closed low and high fire pressure-electric switches which sense and are sequentially closed by increasingly negative pressure in the draft inducer fan. Upon a call for heat from a thermostat located in the conditioned space served by the furnace, the draft inducer fan is energized at its high speed setting, and a signal is sent to the fuel valve to set it at its full firing rate flow when opened by an ignition switch portion of the control system. The control system functions to open the fuel valve at this maximum flow setting, and permit light-off of the burner, only if (1) both of the low and high fire pressure-electric switches are closed, and (2) the draft inducer fan is operating at its high speed setting. In this manner, in addition to providing a wide range of furnace heating output modulation, reliable burner ignition is facilitated and heat exchanger warm-up corrosion is reduced due to the full firing rate start-up of the furnace. Moreover, the incorporation of the two-speed draft inducer fan substantially improves the overall fuel efficiency of the furnace.

10 Claims, 1 Drawing Sheet

MODULATING FURNACE WITH TWO-SPEED DRAFT INDUCER

BACKGROUND OF THE INVENTION

The present invention generally relates to fuel-fired heating appliances and, in a preferred embodiment thereof, more particularly relates to a gas-fired forced air heating furnace having a two-speed draft inducer fan and an associated modulating control system functioning to accurately balance the heating output of the furnace with the heating demand load of the conditioned space served by the furnace.

Early fuel-fired air heating furnace designs incorporated a single furnace firing rate such that, under the control of a thermostat in the conditioned space served by the furnace, the furnace burner was either off or firing at a single maximum firing rate—i.e., the furnace was operated in a very simple "on/off" mode from a heat output standpoint. While this control approach had the benefit of simplicity, as furnace owners and users became more sophisticated it became less and less desirable from a comfort standpoint. More specifically, since it failed to precisely match the furnace heating output to the heating demand of the conditioned space served by the furnace, wide "swings" in conditioned space temperature were a common undesirable occurrence.

One of the first proposed comfort level improvements was to provide a fuel-fired air heating furnace with a two stage control system such that the furnace could be fired at either a "high" or "low" heating output rate. Thus, if the sensed conditioned space temperature was only slightly below the desired temperature control point therefor, the furnace (via an associated conditioned space thermostat) could be operated at its low firing rate to heat the conditioned space while satisfying its relatively modest heating demand load. On the other hand, if the sensed conditioned space temperature was substantially below the desired temperature control point therefor, the furnace could be operated at its high firing rate to handle a much greater conditioned space heating demand load.

As might be imagined, this two stage control of a fuel-fired air heating furnace yielded a higher comfort level in the conditioned space served by the furnace. However, it was only an incremental improvement in the overall conditioned space comfort level, since the heating output of the furnace was not precisely matched with each of the varying heating demand loads of the conditioned space. Moreover, the use of a two stage firing format introduced another problem—the necessity for a corresponding two stage thermostat to call for either a high fire or a low fire condition of the furnace burner. Most off-the-shelf two stage thermostats were primarily designed for commercial/industrial applications, and were not particularly well suited (from a heating comfort standpoint) for residential applications. Custom designed two stage thermostats were proposed, but tended to be quite expensive and thus rather undesirable for residential heating applications.

In view of the shortcomings in both single firing rate and two stage furnace designs, various types of modulating furnaces were proposed in which the firing rate of the furnace was fully modulatable between a minimum firing rate (typically on the order of about 60 to 70 percent of full firing rate) and the maximum firing rate of the furnace. This proposed modulating control scheme, while potentially giving the furnace a significantly better matching between the furnace heating output and the heating demand load of its conditioned space, did not prove to be commercially successful on a wide scale due to associated problems such as complexity, high cost, relatively low reliability, and the need for a custom thermostat which further added to the overall modulatable heating system's cost.

Another limitation of this previously proposed type of modulatable furnace was the rather limited range of modulation—i.e., from full fire down to about 60 to 70 percent of full firing rate. This relatively high lower firing rate limit was required to meet two primary design parameters. First, when a low firing rate burner light-off condition was encountered during system operation, it was necessary to fire the burner at this 60–70 percent firing rate to avoid a corrosive "slow" warm-up condition in the heat exchanger. Second, is was deemed necessary to assure proper burner ignition when conventional inshot-type fuel burners were utilized in the overall furnace assembly. Because of the previous necessity of using this relatively high lower firing rate, the matching between the furnace heating output and the conditioned space heating demand load was less than optimal.

Conventional design wisdom also dictated that in these proposed modulating furnace designs a single speed draft inducer fan be utilized since a fully modulated draft inducer fan was considered to be too expensive, particularly in residential heating applications, to be incorporated into the furnace. While the use of a fixed speed draft inducer fan reduced the fabrication cost of the furnace, it also reduced its fuel efficiency since when the furnace firing rate was modulated downwardly the excess combustion air increased, thereby correspondingly driving the fuel efficiency down.

In view of the foregoing it can readily be seen that it would be highly desirable to provide an improved modulating, forced draft, fuel-fired air heating furnace which eliminates or at least substantially reduces the above-mentioned problems, limitations and disadvantages typically associated with previously proposed modulating furnaces of the type generally described above. It is accordingly an object of the present invention to provide such an improved furnace.

SUMMARY OF THE INVENTION

In carrying out principles of the present invention, in accordance with a preferred embodiment thereof, a modulating, forced draft, fuel-fired air heating furnace is provided which includes a heat exchanger through which hot combustion gas may be flowed; a two-speed draft inducer fan; an air blower operative to flow air to be heated across the heat exchanger; a burner, representatively a gas burner, operative to receive fuel from a source thereof, burn the received fuel, and flow resulting hot combustion gas into the interior of the heat exchanger; and a fuel supply valve, representatively a gas supply valve, coupled to the burner and selectively operable in either a low fire mode or a high fire mode.

In a preferred embodiment thereof, the furnace is provided with a control system that representatively includes normally open low and high fire switches operative to be respectively closed by the successive generation of first and second predetermined pressures within the draft inducer fan. The control system also representatively includes an ignition circuit, responsive to the generation of a heating demand signal from a conditioned space served by the furnace, for initiating operation of the draft inducer fan at its high speed, setting the fuel supply valve to its high fire mode thereof (and at its maximum fuel flow rate), and then lighting the burner if and only if each of the low and high fire switches is closed.

Preferably, the fuel supply valve, in its low fire mode, is operative to deliver a fixed minimum flow rate of fuel from the source thereof to the burner. In its high fire mode, the fuel supply valve is operative to deliver, from the fuel source to the burner, a fuel flow which is modulatable from the minimum fuel flow rate to a predetermined maximum fuel flow rate. Representatively, the minimum fuel flow rate is approximately forty percent of the maximum fuel flow rate.

After lighting the burner, and in response to the magnitude of the heating demand signal, the control system is further operative to automatically (1) maintain the operation of the draft inducer fan at its high speed and modulate the fuel supply valve in its high fire mode between the valve's minimum and maximum fuel flow rates, or (2) cause the draft inducer fan to be driven at its low speed and operate the fuel supply valve in its low fire mode.

With the furnace minimum firing rate at about forty percent of its maximum firing rate, and the control system's ability to modulate the firing rate (with the furnace in its high fire mode) between 40 and 100 percent, the furnace provides a comfortable matching of its heating output to the heating demand load of the conditioned space which is served by the furnace. However, because the burner is lit only at its maximum firing rate, and with the two-speed draft inducer fan being operated at its high speed setting, the light-off efficiency of the burner is not undesirably diminished, and warm-up corrosive condensation problems in the heat exchanger are substantially eliminated.

The fuel supply valve preferably has a main portion and a servo portion. In a preferred embodiment thereof, the furnace control system comprises (1) an ignition switch having an input side, and an output side coupled by first and second electrical leads to the main fuel supply valve portion, (2) a microprocessor coupled to the draft inducer fan by high and low speed electrical signal leads, coupled to the servo portion of the fuel supply valve by a variable output third electrical lead, and coupled to the input side of the ignition switch by a fourth electrical lead. The normally open high fire switch is a pressure-electric switch coupled to the microprocessor by a first electrical switch open/switch closed sensing line, and also coupled to the interior of the draft inducer fan by a first pressure sensing line. The normally open low fire switch is a pressure-electric switch coupled to the microprocessor by a second electrical switch open/switch closed sensing line, and also coupled to the interior of the draft inducer fan by a second pressure sensing line.

Under a first furnace operating condition both of the low and high fire switches are open, with the draft inducer fan being driven at its low speed, and the heat exchanger being at a first temperature. Under a second furnace operating condition the low fire switch closes and the high fire switch remains open, with the draft inducer fan being driven at its low speed, and the heat exchanger being at a second temperature higher than its first temperature. Under a third furnace operating condition the low and high fire switches are both closed, with the draft inducer fan being driven at its high speed and the heat exchanger being at its first temperature. Under a fourth furnace operating condition the low and high fire switches are closed, with the draft inducer fan being driven at its high speed and the heat exchanger being at its higher second temperature.

Representatively, the pressure within the draft inducer fan is (1) less than about −0.5" W.C. when the furnace is in its operating condition, (2) within the range of from about −0.7" W.C. to about −0.9" W.C. when the furnace is in its second operating condition, (3) within the range of from about −1.2" W.C. to about −1.4" W.C. when the furnace is in its third operating condition, and (4) within the range of from about −1.5" W.C. to about −1.75" W.C. when the furnace is in its fourth operating condition.

DETAILED DESCRIPTION

Figure 1:
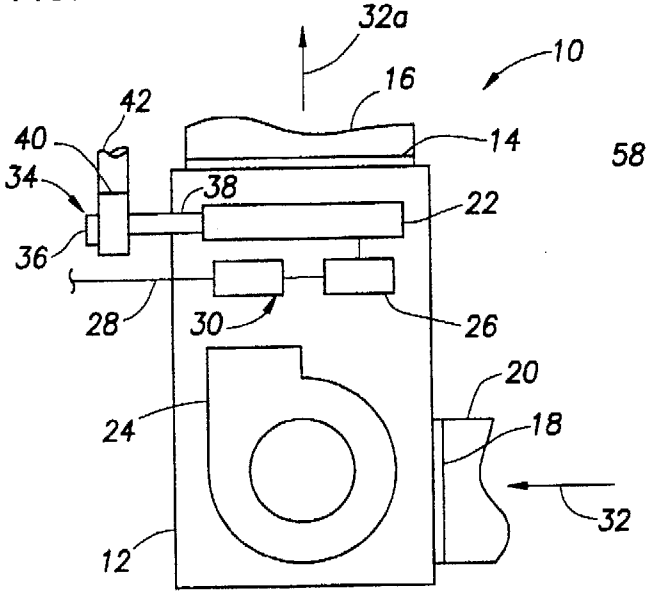
FIG. 1 is a schematic diagram of a representative forced draft, fuel-fired modulatable air heating furnace embodying principles of the present invention.

The present invention provides a specially designed forced draft, modulating, fuel-fired air heating furnace 10 (FIG. 1) that includes a housing 12 representatively having an upper end supply air outlet opening 14 to which supply air ductwork 16 is connected, and a lower side return air inlet opening 18 to which return air ductwork 20 is connected. A heat exchanger 22 is positioned within a top interior portion of the housing 12, above a supply air blower 24 therein, and is associated with a fuel burner 26 (which is representatively a gas burner) supplied with fuel via a gas supply line 28 in which a gas valve 30 is installed. Burner 26 is operative to inject flames, and resulting hot combustion gases, into the interior of the heat exchanger 22.

During operation of the furnace 10, the supply blower 24 draws return air 32 from the conditioned space served by the furnace into the housing 12 through the return ductwork 20 and the housing opening 18 and forces the air 32 upwardly across the heat exchanger 22. Combustion heat is transferred from the heat exchanger 22 to the air 32 creating heated air **32*a* which is forced back to the conditioned space through the housing opening 14 and the supply ductwork 16** connected thereto.

Cooled combustion gases within the heat exchanger 22 are withdrawn therefrom by a two-speed draft inducer fan 34 having an electric drive motor 36, and an inlet 38 communicated with the interior of the heat exchanger 22. The outlet 40 of the draft inducer fan 34 is connected with a vent stack 42 through which the cooled combustion gases are discharged.

Figure 2:
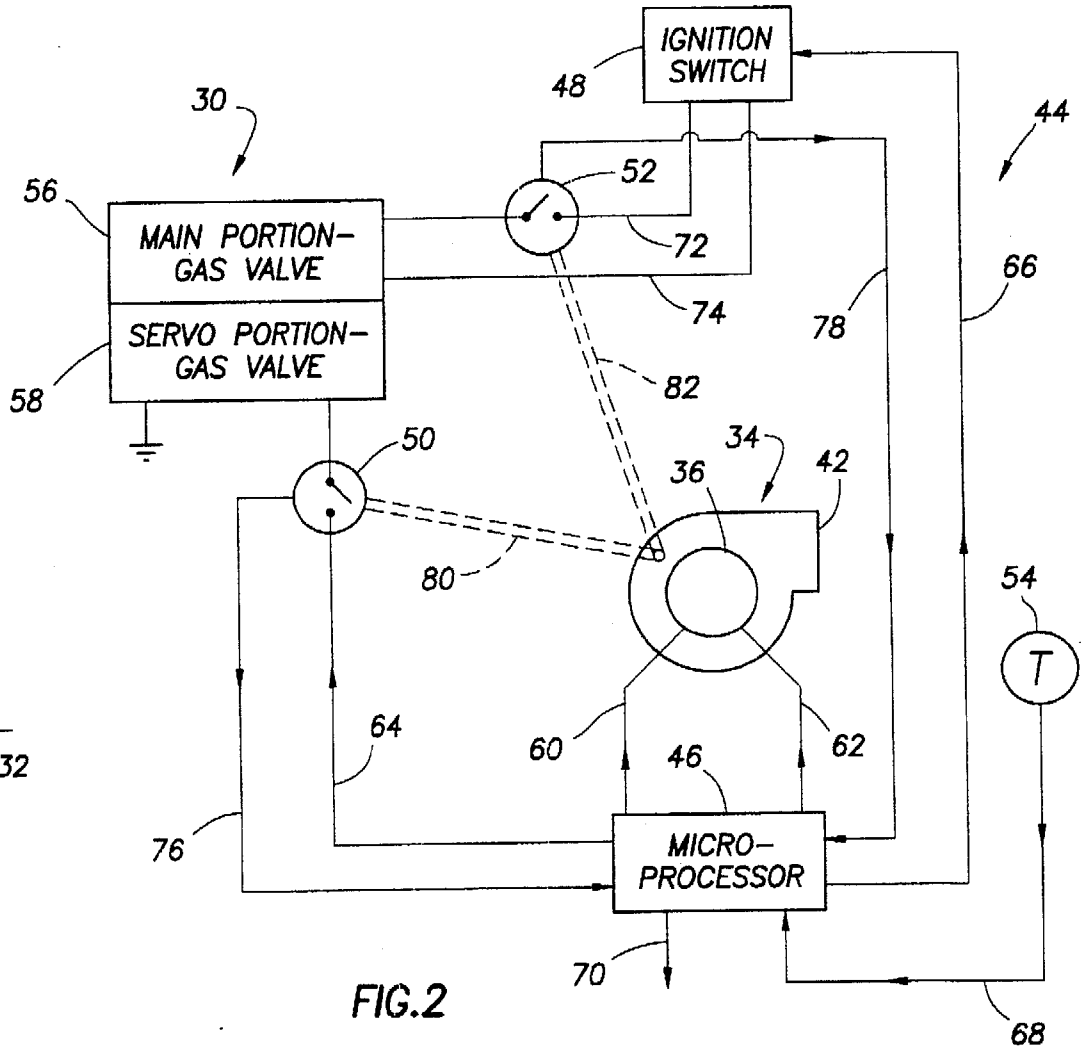
FIG. 2 is a schematic diagram of a specially designed control system embodying principles of the present invention and operatively incorporated in the furnace.

A specially designed modulating control system 44, embodying principles of the present invention, is operatively associated with the furnace 10 and is schematically depicted in FIG. 2. Control system 44 includes a microprocessor 46; an ignition switch 48; a normally open high fire pressure-electric switch 50; a normally open low fire pressure-electric switch 52; and a suitable thermostat 54 located in the conditioned space served by the furnace 10. Thermostat 54 may be a single stage thermostat, a two-stage thermostat, or a modulating thermostat.

Gas valve 30 has an electrically operable main portion 56 which is modulatable between a maximum gas throughflow rate and a minimum gas throughflow rate which is representatively 40 percent of the maximum gas throughflow rate. The gas valve 30 also has an servo portion 58 which is electrically operable to selectively vary the gas throughput of the main valve portion 56 between its minimum and maximum settings.

The microprocessor 46 is coupled (1) to the draft inducer fan motor 36 low and high speed signal leads 60 and 62, (2) to the gas valve servo portion 58 by a variable output electrical power lead 64 in which the high fire pressure-electric switch 50 is operably interposed, (3) to the ignition switch 48 by an electrical power lead 66, (4) to the thermostat 54 by a heating demand signal lead 68, and (5) to the supply air blower 24 (see FIG. 1) by an electrical power lead 70.

Ignition switch 48 is operatively coupled to the main gas valve portion 56 by a pair of electrical output power leads 72 and 74, with the low fire pressure-electric switch 52 being operably interposed in the lead 72. Electrical sensing lines 76, 78 are respectively coupled between the high and low fire pressure-electric switches 50, 52 and the microprocessor 46 and serve to indicate to the microprocessor whether their associated pressure-electric switches are open or closed. The high and low fire pressure-electric switches 50, 52 respectively monitor the air pressure (representatively a negative pressure) within the draft inducer fan 34 by pressure sensing air conduits 80, 82 respectively routed from the switches 50, 52 to the draft inducer fan 34 as schematically indicated in FIG. 2.

With the burner 30 off, upon an initial call for heat from the thermostat 54 (via the signal lead 68) to the microprocessor 46, the microprocessor 46 automatically outputs a high speed run signal via lead 62 to start the draft inducer fan 34 at its high speed setting for a predetermined "purge" time interval. At the end of this interval, if the microprocessor 46 is receiving signals through the sensing leads 76, 78 indicating that both of the pressure-electric switches 50, 52 are closed, the microprocessor outputs a signal via lead 64 to the gas valve servo portion 58 to set the gas throughput value of the main valve portion 56 at its maximum 100 percent firing rate setting when it is later opened. Next, the microprocessor 46 transmits a signal through the lead 66 to the ignition switch 48 which, in turn, sends electrical power (via leads 72 and 74) to the main gas valve portion 56 to open it (at its pre-set maximum gas throughflow rate) and ignite the burner 26 (see FIG. 1) at its maximum firing rate.

This 100 percent initial burner light-off firing rate is then maintained for a predetermined time interval (representatively about 20 seconds). After the expiration of this time interval, the microprocessor outputs the signal 70 to energize the supply air blower 24 (see FIG. 1). Then, according to the conditioned space heating demand load signal 68 transmitted to the microprocessor 46 from the thermostat 54, the microprocessor modulates the signal 64 to correspondingly modulate the gas valve 30 between its 40 percent minimum and 100 percent maximum settings as necessary.

Thus, in accordance with a key aspect of the present invention the control system 44 functions to assure that burner light-off in the furnace 10 can occur only if (1) the draft inducer fan 34 is operating at its high speed setting, and (2) both of the normally open pressure-electric switches 50, 52 are closed. In this manner, two primary operating benefits are achieved. First, by assuring that the burner lights off only under its maximum firing rate, with the draft inducer fan correspondingly operating at its high speed setting, the control system 44 serves to substantially reduce corrosive warm-up conditions within the heat exchanger 22. Second, because of the maximum throughflow setting of the gas valve at burner light-off, burner ignition reliability is substantially enhanced.

During operation of the draft inducer fan 34, the air conduits 80, 82 sense and transmit to their respective pressure-electric switches 50, 52 four pressure conditions within the interior of the draft inducer fan 34. In order of increasing negative internal draft inducer fan pressures, these four sensed pressure conditions, together with the corresponding open/closed states of the switches 50 and 52, are as follows:

1. Low draft inducer fan speed/cold heat exchanger, in which case both pressure-electric switches 50, 52 remain open, with the sensed negative internal draft inducer fan pressure being about −0.5" W.C. or less;
2. Low draft inducer fan speed/hot heat exchanger, in which case the low fire pressure-electric switch 52 closes, and the high fire pressure-electric switch 50 remains open, with the sensed negative internal draft inducer fan pressure being in the range of from approximately −0.7" W.C. to about −0.9" W.C.;
3. High draft inducer fan speed/cold heat exchanger, in which case both of the pressure-electric switches 50, 52 are closed, with the sensed negative internal draft inducer fan pressure being in the range of from approximately −1.20" W.C. to approximately −1.4" W.C.; and
4. High draft inducer fan speed/hot heat exchanger, in which case both of the pressure-electric switches 50, 52 are closed, with the sensed negative internal draft inducer fan pressure being in the range of from approximately −1.5" W.C. to about −1.75" W.C.

After the initial 100 percent firing rate burner light-off described above, the furnace 10 may be modulated between its 40 percent firing rate and its 100 percent firing rate, by appropriately varying the servo control signal 64, to provide a comfortable matching between the furnace heat output rate and the conditioned space heating demand load. Specifically, when only the low fire switch 52 is closed during this post light-off operating period of the furnace (indicative of a lowered conditioned space heating demand load), the draft inducer fan 34 runs at its low speed setting in response to the generation by the microprocessor 46 of a low speed operating signal via lead 60, and the gas valve servo portion 58 is not receiving a modulating signal via lead 64. Accordingly, the electrical power transmitted from the switch 48 to the main gas valve portion 56 maintains the gas valve 30 in its low fire operation—representatively at approximately a 40 percent firing rate as previously described.

However, when the thermostat 54 calls for a sufficiently larger amount of conditioned space heat delivery the microprocessor 46 terminates the low speed draft inducer fan signal 60 and generates, instead, the high speed draft inducer fan signal 62 to thereby operate the draft inducer fan 34 at its high speed setting. This closes the high fire pressure-electric switch 50 and again places the gas valve servo portion 58 under the control of the modulating signal 64 to provide for automatic gas valve modulation between its 40 percent minimum gas throughflow setting and its 100 percent maximum gas throughflow setting under the control of the thermostat 54.

The foregoing detailed description is to be clearly understood as being given by way of illustration and example only, the spirit and scope of the present invention being limited solely by the appended claims.

What is claimed is:

1. A fuel-fired air heating furnace comprising:

a heat exchanger through which hot combustion gas may be flowed;

a two-speed draft inducer fan operatively connected to said heat exchanger and being selectively drivable at a low speed and a high speed;

an air blower operative to flow air to be heated across said heat exchanger;

a burner operative to receive fuel from a source thereof, burn the received fuel, and flow resulting hot combustion gas into the interior of said heat exchanger;

a fuel supply valve coupled to said burner and selectively operable in either a low fire mode or a high fire mode, said fuel supply valve, in said low fire mode thereof, being operative to deliver a fixed minimum flow rate of fuel from said source thereof to said burner, said fuel supply valve, in said high fire mode thereof, being operative to deliver, from said fuel source to said burner, a fuel flow which is modulatable from said minimum flow rate of fuel to a predetermined maximum flow rate of fuel; and a control system including (1) normally open low and high fire switches operative to be respectively closed by the successive generation of first and second predetermined pressures within said draft inducer fan, and (2) an ignition circuit, responsive to the generation of any heating demand signal from a conditioned space served by said furnace, for initiating operation of said draft inducer fan at said high speed thereof, setting said fuel supply valve to said high fire mode thereof, and then lighting said burner if and only if each of said low and high fire switches is closed, said control system being further operative, after lighting said burner and in response to the magnitude of the heating demand signal, to automatically (1) maintain the operation of said draft inducer fan at said high speed thereof, and modulate said fuel supply valve in said high fire mode thereof between said predetermined minimum and maximum fuel flow rates thereof, or (2) cause said draft inducer fan to be driven at said low speed thereof and operate said fuel supply valve in said low fire mode thereof.

2. The fuel-fired air heating furnace of claim 1 wherein:

said minimum flow rate of fuel is approximately forty percent of said maximum flow rate of fuel.

3. The fuel-fired air heating furnace of claim 1 wherein:

under a first furnace operating condition both of said low and high fire switches are open, with said draft inducer fan being driven at said low speed thereof and said heat exchanger being at a first temperature, under a second furnace operating condition said low fire switch closes and said high fire switch remains open, with said draft inducer fan being driven at said low speed thereof and said heat exchanger being at a second temperature higher than said first temperature, under a third furnace operating condition said low and high fire switches are closed, with said draft inducer fan being driven at said high speed thereof and said heat exchanger being at said first temperature thereof, and under a fourth furnace operating condition said low and high fire switches are closed, with said draft inducer fan being driven at said high speed thereof and said heat exchanger being at said second temperature thereof.

4. The fuel-fired air heating furnace of claim 3 wherein:

said low and high fire switches are pressure-electric switches coupled to said draft inducer fan to sense a pressure therein, and said pressure in said draft inducer fan is (1) less than about −0.5" W.C. when said furnace is in said first operating condition, (2) within the range of from about −0.7" W.C. to about −0.9" W.C. when said furnace is in said second operating condition, (3) within the range of from about −1.2" W.C. to about −1.4" W.C. when said furnace is in said third operating condition, and (4) within the range of from about −1.5" W.C. to about −1.75" W.C. when said furnace is in said fourth operating condition.

5. The fuel-fired air heating furnace of claim 1 wherein said fuel supply valve is a gas fuel supply valve.

6. A fuel-fired air heating furnace comprising:

a heat exchanger through which hot combustion gas may be flowed;

a two-speed draft inducer fan operatively connected to said heat exchanger and having selectable high and low speeds;

an air blower operative to flow air to be heated across said heat exchanger;

a burner operative to receive fuel from a source thereof, burn the received fuel, and flow resulting hot combustion gas into the interior of said heat exchanger;

a fuel supply valve coupled to said burner and having a main portion and a servo portion, said fuel supply valve being selectively operable in either (1) a low fire mode in which said fuel supply valve is operative to deliver a fixed minimum flow rate of fuel from said source thereof to said burner, or (2) a high fire mode in which said fuel supply valve is operative to deliver, from said fuel source to said burner, a fuel flow which is modulatable from said minimum flow rate of fuel to a predetermined maximum flow rate of fuel; and control means for regulating the operation of said fuel supply valve, said burner and said draft inducer fan, said control means including:

an ignition switch having an input side, and an output side coupled by first and second electrical leads to said main fuel supply valve portion, a microprocessor coupled to (1) said draft inducer fan drive motor by high and low speed electrical signal leads, (2) said servo portion of said fuel supply valve by a variable output third electrical lead, and (3) said input side of said ignition switch by a fourth electrical lead, a normally open high fire pressure-electric switch operably interposed in said third electrical lead, said high fire pressure-electric switch being coupled to said microprocessor by a first electrical switch open/switch closed sensing line, and being further coupled to the interior of said draft inducer fan by a first pressure sensing line, and a normally open low fire pressure-electric switch operably interposed in one of said first and second electrical leads, said low fire pressure-electric switch being coupled to said microprocessor by a second electrical switch open/switch closed sensing line, and being further coupled to the interior of said draft inducer fan by a second pressure sensing line, said control means being operative to start-up said furnace by sequentially initiating operation of said draft inducer fan motor at said high speed thereof, and then lighting said burner during high speed operation of said draft inducer fan if and only if both of said high fire and low fire pressure-electric switches are closed, and then control the heat output of said furnace, in response to the magnitude of a heating demand signal received from a conditioned space served by said furnace, by selectively (1) operating said fuel supply valve in said low fire mode with said draft inducer fan drive motor being operated at said low speed thereof, or (2) operating said fuel supply valve in said high fire mode, with said draft inducer fan drive motor being operated at said high speed thereof, and modulating the fuel flow through said fuel supply valve between said minimum flow rate and said maximum flow rate.

7. The fuel-fired air heating furnace of claim 6 wherein:

said fixed minimum flow rate of fuel is approximately forty percent of said maximum flow rate of fuel.

8. The fuel-fired air heating furnace of claim 6 wherein:

said burner is a gas burner, and said fuel supply valve is a gas supply valve.

9. The fuel-fired air heating furnace of claim 6 wherein:

under a first furnace operating condition both of said low and high fire switches are open, with said draft inducer fan motor being driven at said low speed thereof and said heat exchanger being at a first temperature, under a second furnace operating condition said low fire switch closes and said high fire switch remains open, with said draft inducer fan motor being driven at said low speed thereof and said heat exchanger being at a second temperature higher than said first temperature, under a third furnace operating condition said low and high fire switches are closed, with said draft inducer fan motor being driven at said high speed thereof and said heat exchanger being at said first temperature thereof, and under a fourth furnace operating condition said low and high fire switches are closed, with said draft inducer fan motor being driven at said high speed thereof and said heat exchanger being at said second temperature thereof.

10. The fuel-fired air heating furnace of claim 9 wherein:

said pressure in said draft inducer fan is (1) less than about −0.5" W.C. when said furnace is in said first operating condition, (2) within the range of from about −0.7" W.C. to about −0.9" W.C. when said furnace is in said second operating condition, (3) within the range of from about −1.2" W.C. to about −1.4" W.C. when said furnace is in said third operating condition, and (4) within the range of from about −1.5" W.C. to about −1.75" W.C. when said furnace is in said fourth operating condition.

* * * * *